United States Patent [19]

Schnelle et al.

[11] 4,361,931

[45] Dec. 7, 1982

[54] FURNITURE FITTING

[75] Inventors: Manfred Schnelle, Hiddenhausen; Manfred von Reden, Bad Oeynhausen; Willi Pittasch, Herford; Peter Busse, Vlotho, all of Fed. Rep. of Germany

[73] Assignee: Firma Richard Heinze GmbH & Co., KG, Fed. Rep. of Germany

[21] Appl. No.: 56,144

[22] Filed: Jul. 9, 1979

[30] Foreign Application Priority Data

Jul. 28, 1978 [DE] Fed. Rep. of Germany ..... 2833120
Feb. 13, 1979 [DE] Fed. Rep. of Germany ..... 2905378

[51] Int. Cl.[3] ..... E05D 5/02

[52] U.S. Cl. ..... 16/252; 403/231; 403/119

[58] Field of Search ..... 403/231, 361, 119; 16/158, 164

[56] References Cited

U.S. PATENT DOCUMENTS

| | | | |
|---|---|---|---|
| 4,069,549 | 1/1978 | Zernig et al. | 16/158 |
| 4,160,610 | 7/1979 | Brown et al. | 403/231 |

FOREIGN PATENT DOCUMENTS

| | | | |
|---|---|---|---|
| 2358163 | 6/1974 | Fed. Rep. of Germany | 403/231 |
| 2522393 | 5/1975 | Fed. Rep. of Germany . | |
| 2231878 | 2/1974 | France | 16/158 |
| 1323462 | 8/1970 | United Kingdom . | |
| 1298779 | 11/1971 | United Kingdom . | |
| 1570297 | 12/1976 | United Kingdom . | |
| 2027482 | 2/1980 | United Kingdom | 16/158 |

*Primary Examiner*—Wayne L. Shedd
*Attorney, Agent, or Firm*—Eyre, Mann, Lucas & Just

[57] ABSTRACT

The invention relates to a furniture fitting in the form of a cup-shaped hinge housing which can be anchored into a bore of a furniture door and used as a door side pivot carrier for a furniture hinge. The hinge housing has a locking element which can be rotated about an axis at right angles to a circumferential wall and which has a section for holding the locking element when it is in a locked position. In a preferred embodiment of the hinge housing, two swivelling locking elements are provided which are connected to each other by a bracket shaped element so that when the bracket shaped element is swivelled to a given position by hand the locking element is moved into a locking position.

21 Claims, 20 Drawing Figures

(I-I)

FURNITURE FITTING

BACKGROUND OF THE INVENTION

The invention relates to a furniture fitting in the form of a cup-shaped hinge housing which can be anchored into a bore of a furniture door and used as a door side pivot carrier for a furniture hinge.

Hinge housings for furniture hinges exist in great variety. Each hinge housing must solve the problem of providing a secure, and particularly, a non-rotating anchoring in the bore of the furniture door. All of the forces, especially those caused by the weight of the door, must be transmitted by means of the hinge housing to the hinge and from there to the furniture body. In addition to this there is the requirement that the hinge housing be simple and compatible with production means already in existence at the furniture manufacturers facilities.

The most usual hinge housing has taken the form of a cup shaped unit having on its circumferential wall several outward projecting, ratchet type ribs, which are pressed laterally into the wall of the bore when the unit is hammered into the bore. To further secure the hinge housing, inclined screws, which are screwed into open holes arranged at an angle to the axis of the hinge housing, are used in addition to the ratchet type ribs. The installation of these hinge housings can normally be carried out as a rule only by trained personnel using special tools.

Other hinge housings are known in which these is at least one locking element which can be rotated or swivelled about an axis which runs parallel to the axis of the cup shaped part or which may be slightly inclined to the axis thereof. In an unlocked position, inclined surfaces remain completely within the circumferential outline of the cup shaped part and when moved to the locked position, the engaging surfaces will project outside the circumferential surface and press into the wall of the bore.

Furthermore, there are hinge housings in which the locking element does not act directly against the wall of the bore, but by means of a special locking section, a portion of the cup shaped element is pushed into the material of the wall of the bore. In the simplest case this locking section is formed by a radially outward expanding part of the hinge housing. The locking element then has a camming face as an eccentric which spreads the expandable section.

In each of these cases a very good non-rotating anchoring of the cup shaped part within the bore of the furniture door can be achieved by the anchoring of these known hinge housings, but they require special tools. The hinge housings having a locking element suffer a basic disadvantage in that rotating the locking element into the locked position also rotates the hinge housing within the bore of the furniture door. Therefore, correct positioning of the hinge housing prior to anchoring in order to achieve the correct position after anchoring is extremely difficult.

An objective of the invention is to provide a hinge housing which avoids these disadvantages and which can be anchored into a single component by untrained individuals having no special tools.

A further object of the invention is to provide a hinge housing having all the elements which are necessary for anchoring the hinge housing contained on the hinge housing so that loose, individual components for the final user to assemble are avoided.

A third object of the invention is to provide a hinge housing which is compatable with the new marketing technique of selling dismantled furniture directly to the buying public. Individual components of dismantled furniture are packed into readily handled packages which are transported by the buyer to be assembled at home. In order to prevent damage to the furniture components, those fittings which project byond the furniture components are supplied separately. Since as a rule the buyers will be nonspecialists, the fittings are designed so that the customer is in a position to assemble the furniture from these individual components without any particular skill and particularly without special tools.

SUMMARY OF THE INVENTION

The invention disclosed herein is a hinge housing having a locking element which can be rotated about an axis at right angles to a circumferential wall and which has a section, situated within an opening in the hinge housing, for holding the locking element when it is in a locked position.

In a preferred embodiment of the hinge housing, two swivelling locking elements are provided which are connected to each other by a bracket shaped element so that swivelling the bracket shaped element by hand causes the locking element to be moved into a locking position.

In the locked position, the bracket shaped element is situated in a groove shaped opening of a projecting overhanging arm molded on the hinge housing. In addition the bracket shaped element may be a plate shaped element which forms a part of the projecting arm.

In the invention, engaging surfaces are designed so that edges of the surfaces are pressed into the furniture bore locking position, locking the element into the material of the furniture component. In this case the edges are advantageously designed as sawtooth formed cutting edges. In addition, the locking element on the hinge housing can act as an expanding element, which, on rotation into the locked position, pushes an expanding section of a cup shaped part which expands radially outward and anchors the furniture fitting component to the bore.

The hinge housing can be rapidly and quickly fitted even by untrained personnel without using any special tools.

The invention is further explained below by means of the figures in which.

Figure 1:
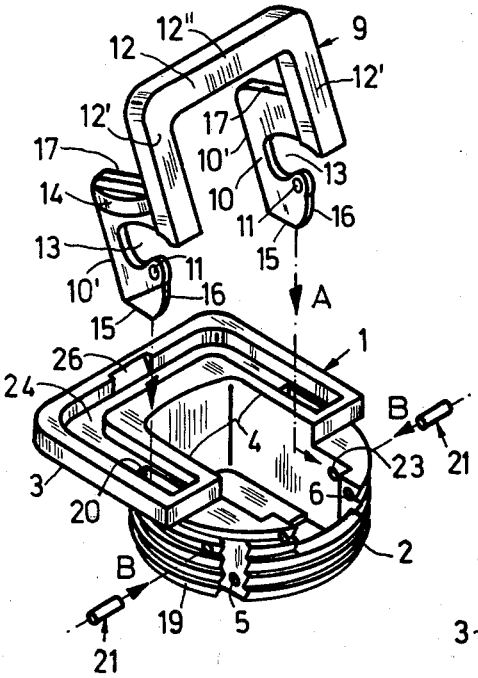
FIG. 1 is a perspective exploded view of a furniture fitting component in the form of a cup shaped hinge housing in which the locking element is separated from the furniture fitting component.

FIGS. 1 to 5 show a furniture fitting component in the form of a hinge housing 1, which consists of a cup-shaped part 2 having a circular cylindrival shaped circumferential surface with an overhanging arm 3 molded on one end projecting beyond the circumferential wall of the cup shaped part. The cup shaped part 2 has a basically rectangular inner chamber 4 which is open towards the upper end face provided with the overhanging arm 3 and it is at least partially closed on the other end face (bottom) by a wall. The hinge housing 1 is normally to be used as the door end bearing support of a furniture hinge, in which, by means of a pivoting axis, not shown in detail, pivoting levers of a hinge, also not shown in detail, are pivoted within the inner chamber 4 of the cup shaped part 2. The holes 5 and 6 situated in the cup shaped part 2 are used to support the pivoting axis.

In order to anchor the cup shaped part 2 into a bore 7 provided on the inner side of the furniture door 8, a locking element 9 is fastened on the cup shaped part 2. The locking element 9, in the embodiment shown, consists of two parallel flat levers 10 separated by a distance. Each of these levers has at one end a bearing hole 11 at right angles to the surface 5 of the lever and at the other end, each is connected to the other lever by a U shaped bracket 12. The bracket has in turn two parallel arms 12′ as well as a yoke 12″ which connects these arms to each other.

The brackets 12 have in the embodiment shown, a rectangular cross section. The levers 10 are fastened in the region of the free ends of the arms 12′ so that the surface sides of the levers 10 are at right angles to the arms 12. This attachment is clearly visible in FIG. 2.

Figure 2:
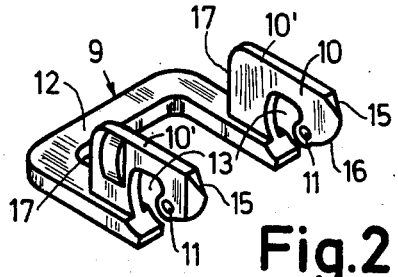
FIG. 2 is a perspective detailed view of the locking element of FIG. 1, viewed from the rear side not visible in FIG. 1.

In addition the flat levers 10, as shown specifically in FIGS. 1 and 2, are arranged on the bracket arms 12′ so that the ends of the levers 10 provided with bearing holes 11 project beyond the free ends of the bracket arms 12′ and in addition the levers 10 project over their whole region laterally from the underside of the bracket 12.

As shown also in FIGS. 1 and 2, this lever 10 is provided with an opening 13, which projects into the given lever 10 and is open towards the free end of the bracket arm 12′ supporting the lever 10. By means of the opening 13 each lever 10 will have a shape approximately curved in the manner of C, in which the bearing hole 11 is arranged at one end and the connection section between the levers 10 and the relevant bracket arms 12′ of the brackets is arranged at the other end of the approximately C shaped lever. The levers 10 are made preferably integrally with the bracket 12.

FIGS. 1 and 2 show also that the bearing hole 11 of each lever 10 is situated closer to the underside of the bracket 12 than the larger part of the section of each lever 10 which is situated between this bearing hole 11 and the connection point with the bracket 12.

On each lever 10 are provided further engaging surfaces 14 and 17, which ensure anchoring of the hinge housing 1 into the bore 7 of the furniture door 8. One engaging surface is, in the embodiment shown, a forward projecting cam 14 which is at right angles to the underside of the bracket 12. This cam is arranged on the outwards situated surface side of each lever 10 and its height increases from the edge remote from the bracket arm 12 of the lever towards the middle of the lever 10. A cam 14 is located on the end of the given lever 10 which is remote from the bearing hole 11 and positioned under the bracket arm 12′ in the vicinity of the connection region between the lever and the bracket 12.

Another engaging surface, is formed by the partly cutter edge shaped edge 15 of a projection 16 projecting in the direction of the bracket 12 beyond the bearing hole 11 of the lever 10. The cutting or engaging edge 15 in this case forms the outside edge of the lever 10 in the region between the end having the bearing hole 11 and the middle region 10′ of this lever which is situated furthest from the bracket arm 12′. The distance separating the cutting or engaging face from the bearing hole 11 increases from the end which is provided with a bearing hole towards the edge of the middle region 10.

Another engaging surface is formed by the outside edge 17 of the lever 10 on the lever end connected to the bracket 12. In the embodiment shown the outside edge 17 runs approximately at right angles to the underside of the relevant bracket arm 12′. It is, however, also possible for the engaging surface to have a slight curvature. Moreover, the outside edge 17 may also take the form of the cutting edge.

Figure 4:
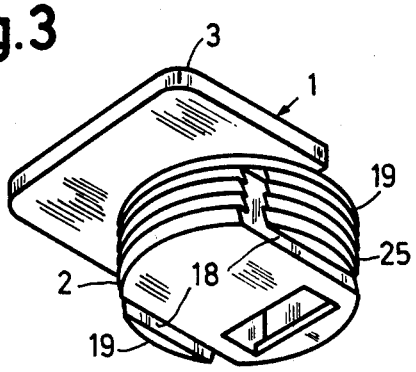
FIG. 4 is a perspective view of the hinge housing according to FIG. 1 from the rear side which is not visible in FIG. 1.

The cup shaped part 2 has two slot shaped openings 18, which run in a plane at right angles to both end faces of the cup shaped part 2 and which intersect the circular cylindrical shaped circumferential wall of the cup shaped part 2. These slot shaped openings 18, as shown in FIG. 4, are open on both sides to the circumferential surface as well as towards the bottom surface of the cup shaped part 2. Each slot shaped opening 18 forms a circumferential wall section 19, which is arcuate on its outside surface, forming a continuation of the circumferential wall of the cup shaped part. Each slot shaped opening 18 is partly open through a slot 20 towards the upper end face of the cup shaped part 2. The slot shaped openings 18 are partitioned from the inner chamber 4 of the hinge housing 1 by wall sections.

For supporting of the locking elements 9 two pivot pins 21 are used, each is held in the bearing holes 22 and 23 on the circumferential wall section 19 as well as on the walls partitioning the inner chamber 4 and the slot shaped opening 18. In the embodiment shown the slot shaped openings 18 are situated parallel to the longitudinal wall of the rectangular inner chamber 4. The bearing holes 22 and 23 are positioned so that pivot pins 21, which pass through the bearing holes 11 when the locking element 9 is mounted, are situated below the closed upper portion of the slot shaped openings 18.

In order to mount the locking element 9, lever 10 of the locking element 9, with projection 16 leading, is pushed in the direction of arrows A through the slot 20 into the slot shaped openings 18, the spacing of which corresponds to the spacing of both levers 10. If necessary, the locking element 9 is then pushed against the hinge housing 1 and/or swivelled until the bearing holes 22 and 23 are aligned with the bearing holes 11 of the levers. The bearing pins 21 are pushed in from the side, i.e. in the direction of the arrows B of FIG. 1 into the bearing holes 11, 22 and 23, so that each lever 10 is held in a slot shpaed opening 18 and is able to rotate about an axis at right angles to the circumferential wall of the cup shaped part 2. The bearing pins 21 are situated in this case nearer to the upper end face of the cup shaped part 2 than to the lower end face (bottom) of this cup shaped part.

Figure 5:
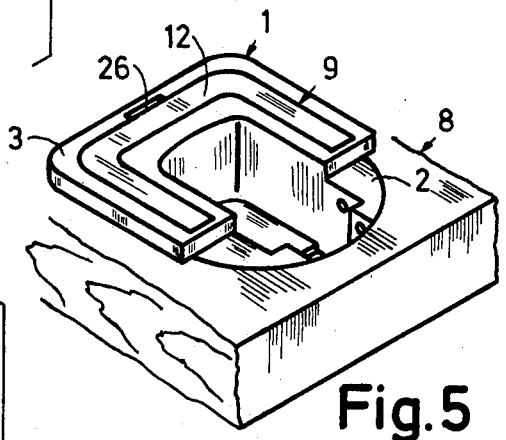
FIG. 5 is a perspective view of the hinge housing according to FIG. 1 after anchoring into the opening in the furniture door.
Figure 3:
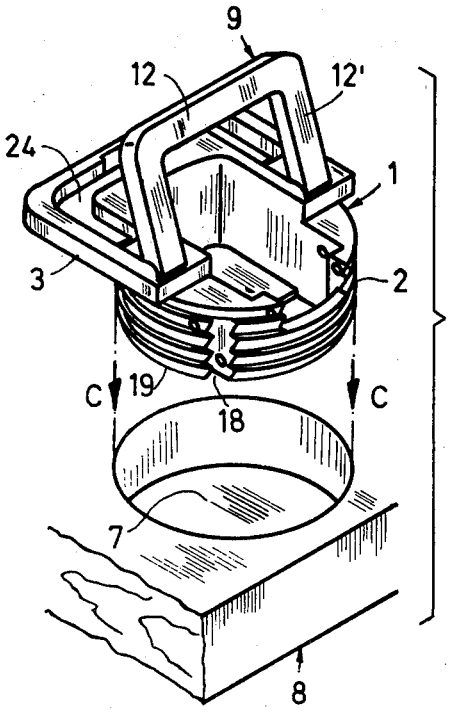
FIG. 3 is a perspective view of the hinge housing of FIG. 1 together with the locking element fasteened on the hinge housing, the locking element not being in the locking position and before the insertion of the hinge housing into the opening of a furniture door.

To fasten the hinge housing 1 on the furniture door 8 the locking element 9 is at first swivelled about the bearing pins 21 so that the bracket 12 assumes the position shown in FIG. 3, i.e. the bracket arms 12 of the bracket 12 are situated at an angle to the top face of the overhanging arm 3. The levers 10 in the region of the opening 13 enclose the edges of slot 20 adjacent to the bearing pins 21 and the section of each lever 10 having the engaging surfaces 14 and 17 is situated outside the relevant slot shaped opening 18. The projection 16 having the edge 15 is situated within the relevant slot shaped opening 18 approximately below the bearing pin 21. In this position of the locking element 9, the hinge housing 1 is inserted along with its cup shaped part 2 in the direction of the arrow C in the FIG. 3 into the hole 7 of the furniture door 8. After insertion the bracket 12 is swivelled on the overhanging arm 3 so that the bracket 12 will be located in a U shaped groove 24 on the upper face of the overhanging arm 3, as shown in FIG. 5. This swivelling of the locking element 9 about the bearing pin 21 ensures that the section of each lever 10 having the engaging surfaces 14 and 17 enters into the associated slot shaped opening and, simultaneously, that the projection 16, having a cutting edge or engaging edge 15, emerges on the open side, adjacent to the bearing pin 21, of the relevant slot shaped opening 18 beyond the circumferential wall of the cup shaped part 2. Thereupon it is pushed into the material of the furniture door 8 or into the wall of the bore 7, as described below in detail in conjunction with FIGS. 6 to 13.

On swivelling the locking element 9 out of the position shown in FIG. 3 into the position shown in FIG. 5 each of the circumferential wall sections 19 are pushed outwards radially by the wedge action engaging surfaces or by cams 14. The width of the slot shaped opening 18 is equal to or only slightly greater than the thickness of the lever 10. By the radial pushing apart of the circumferential wall sections 19 the hook action ribs 15 located on the outside of this circumferential wall section are pushed into the material of the furniture door 2 in the region surrounding bore 7.

In addition, the length of the levers 10, as well as the positions of the bearing holes 22, 23 and 11, are selected so that when the locking element 9 (FIG. 5) swivelled over on the overhanging arm 3, the edges 17 of the lever 10 project on the open side of the slot shaped opening 18 furthest from the bearing pins 21, slightly beyond the circumference of the cup shaped part 2. Therefore these edges are either in contact with or pushed into the material of the furniture door 8 at the wall of the bore 7.

It is of course also possible that the length of the levers 10 as well as the arrangement of the bearing holes 11, 22 and 23 is such that in the anchored hinge housing 1 the edges 17 of the levers 10 will not become effective as engaging edges or, that they are positioned within the circumferential surface of the cup shaped part in the slot shaped openings 18. In this case the anchoring is carried out only by the engaging surfaces 14 as well as by the edges 15. The contact of the edges 17 against the wall of the bore 7 has the advantage that the bearing pins 21 are to a very great extent relieved of the shearing forces which act in the direction parallel to the inner surface of the furniture door 8. A relief of the shearing forces of this kind on the bearing pins 21 is also achieved by having the bracket 12 situated within the U shaped groove 24.

A slot shaped opening 26 is provided in the U shaped groove 24 under the yoke 12″ through which a screwdriver, or other suitable tool can be pushed to swivel the bracket out of the groove 24.

The bracket 12 may be related in its shape and molding to the form and molding design of the overhanging arm 3 that this bracket will hardly be visible when the hinge housing 1 is anchored. It also may optionally be formed as a decorative element.

FIGS. 6 to 13 show another embodiment of the furniture fitting according to the invention. Hinge housing 1′, conforms to a very great extent to the hinge housing 1 of FIGS. 1 to 5.

The locking element 9′ provided in the hinge housing 1′ consists of a flat plate bracket 27 having a horseshoe shaped form with two arms 27′ and a yoke 27″ connecting these two arms enclosing a lateral opening 28. The arms 27′ and the yoke 27″ are flat, plate shaped sections, on which at the underside of the arm 27′, not visible in FIG. 6, there are molded two flat levers 10. These levers run parallel to each other and at right angles to the surface sides of the plate shaped bracket 27.

Figure 6:
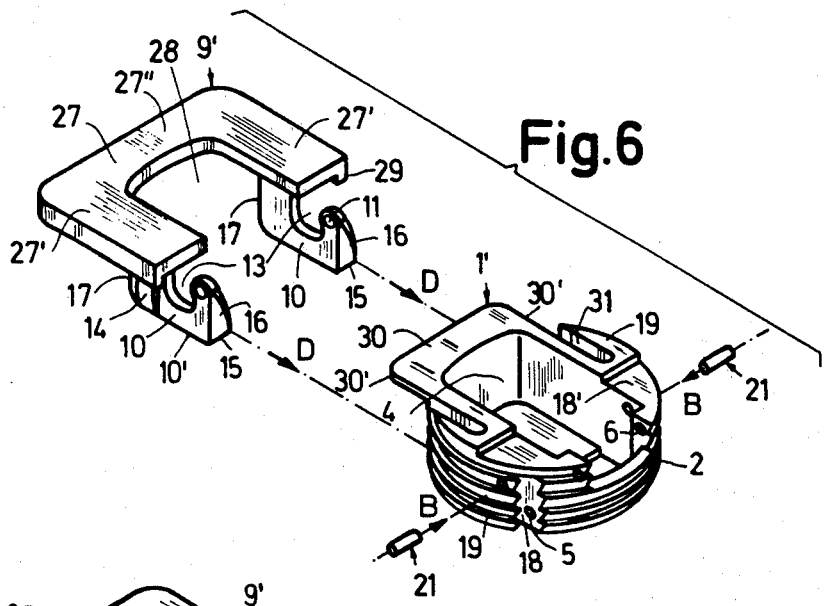
FIG. 6 is a perspective exploded view of a further embodiment of the furniture fitting component according to the invention in the form of a hinged housing having the locking element removed.
Figure 8:
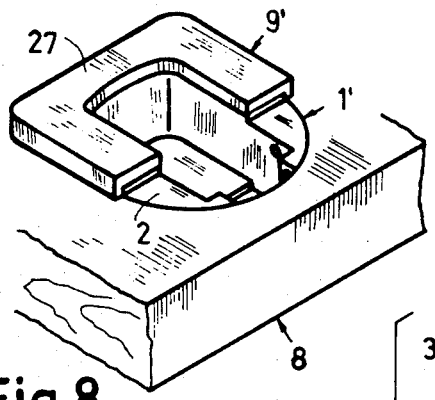
FIG. 8 is a perspective view of the hinge housing according to FIG. 6 after its anchoring into the opening of the furniture door.

On the underside not visible in FIG. 6 the plate shaped bracket 27 is provided with an edge 29 which 29 which projects at right angles from the surface, this edge projects over the whole length of the arms 27′ as well as over the whole width of the yoke 27″. A laterally projecting overhanging arm 30, which corresponds to the overhanging arm 3 of FIGS. 1 to 5 is formed on the upper end face of the cup shaped part 2. However, it is significantly shorter and narrower than the overhanging arm 3. When the hinge housing 1 is anchored, the overhanging arm 30 is situated under the yoke 27" within the edge 29. The overhanging arm 30 in this embodiment thus establishes the penetration depth of the cup shaped part within the hole 7 of the furniture door 8. For anchoring the cup shaped part 2 in the bore 7 the locking element 9' must be capable of being swivelled out of the non-locking position shown in FIG. 7 fully into the locking position shown in FIG. 8, in which the plate shaped element 27, together with its edge 29, is in contact against the inner face of the furniture door 8. This will not be possible if the cup shaped part 2 is inserted too deeply into the bore 7.

As shown by FIG. 6, the overhanging arm 30 is only wide enough for its side edges 30 to be aligned with the inner faces of the slots shaped 18. In this embodiment, on the upper end face of the cup shaped part 2, instead of the closed slots 18, an open slot 31 is provided which will join the slot shaped opening 18, which are open also towards their side facing the overhanging arm 30. To mount the locking element 9', the lever 10 is pushed in the direction of the arrows D, inwards from the side into the slot shaped openings 18. Also in the embodiment of FIGS. 6 to 13, the locking element 9' is pivotally attached by the bearing pins 21. These pins pass through the bearing holes 11 of the lever 10 and into the circumferential wall sections 19 as well as through the slot shaped openings 18 of the inner chamber 4 partition walls below the face 18', connecting the circumferential sections 19 with the remaining cup shaped part 2 and partly closing the slot openings 18 towards the upper end face of the cup shaped part 2.

Figure 7:
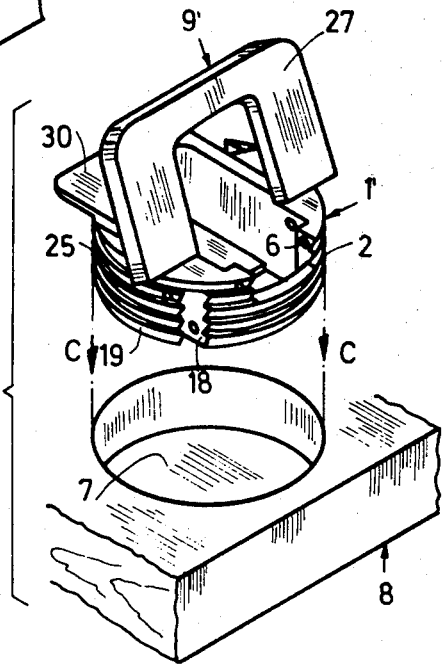
FIG. 7 is a perspective view of the hinge housing according to FIG. 6 with the locking element fastened on the hinge housing, the locking element being in the unlocked position and before the insertion of the hinge housing into an opening of the furniture door.
Figure 9:
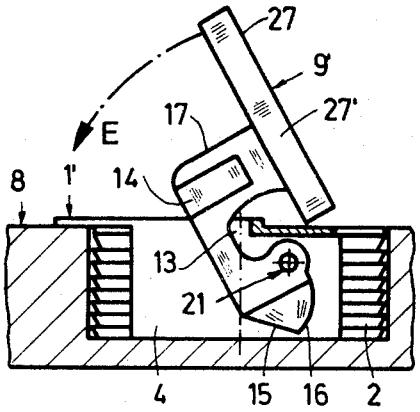
FIG. 9 is a side view of the hinge housing according to FIG. 6 inserted in the opening of the furniture door, and wherein the wall of the hinge housing in the region of the locking element is partly sectioned.
Figure 10:
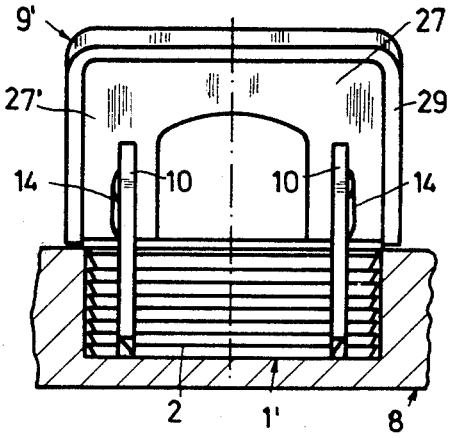
FIG. 10 is a view as in FIG. 9, in the viewing direction rotated relative to that of FIG. 9 by 90°.

The nonlocking position of the locking element 9 is shown in FIGS. 7, 9 and 10. In this nonlocking position the cup shaped part 2 is inserted in the direction of arrows C in FIG. 7 into the bore 7 of the furniture door 8. After insertion, the hinge housing 1' will assume the position shown in FIGS. 9 and 10. The locking element 9 is then swivelled about the bearing pins 21 in the direction of the arrow E of FIG. 9, so that the plate shaped element which initially is situated at an angle to the inner surface of the furniture side is positioned with its upper surface side parallel to this inner surface. The locked position is shown in the FIGS. 8 and 11 to 13.

While in the nonlocking position of the locking element 9 (FIG. 9) the engaging surfaces 15 and 17 are situated outside the slot shaped openings 18 and the edges 15 are situated within the slot shaped openings 18 inside the circumferential surface of the cup shaped part 2, as described previously in conjunction with the locking element 9.

Figure 11:
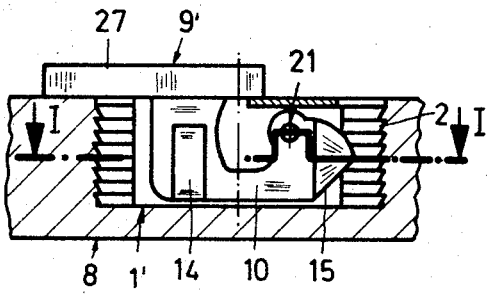
FIG. 11 is a view of FIG. 9, with the hinge housing anchored.
Figure 12:
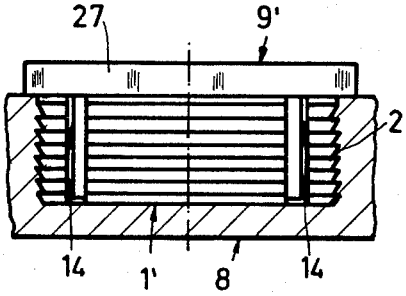
FIG. 12 is a view as in FIG. 10, with the hinge housing anchored.
Figure 13:
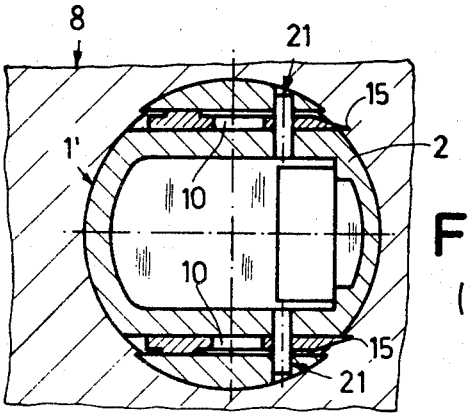
FIG. 13 is a section along the line I—I of FIG. 11.

FIGS. 11 and 13 show that in the locking position of the locking element 9 the engaging surfaces 15 and 17 are pushed into the material of the door; a radial expansion of the circumferential wall sections 19 outwards occurs as cams 14 are engaged. By this means an anchoring of the cup shaped part 2 in the bore 7 can effectively accommodate the tension forces acting in the direction at right angles to the inner surface of the furniture door 9 as well as the torsional forces acting about the axis of the bore 7. In particular, rotation is prevented by the engaging surfaces 15 and 17 being pushed into the wall of the bore 7.

As indicated in FIG. 13 with broken lines, it is also possible for the edge 17 located furthest from the bearing pins 21 on levers 10 to be situated within the shot shaped openings 18 so that this edge will not act as an engaging face when locking element 9 is in the locking position.

In this case the hook type ribs 25 provided on the section of cup shaped part 2 situated below the overhanging arm 30 will be pressed into contact against the wall of the bore 7.

As shown particularly in FIGS. 9 and 11 the distance from the engaging surfaces or cam 14 from the bearing pin 21 is greater than the distance between the edge 15 and this bearing pin. This arrangement ensures that, even in the case of high tensile forces exerted on the cup shaped part 2 in the direction at right angles to the inner face of the furniture door 8, the anchoring will not loosen because of undesirable swivelling of the locking element 9.

The hinge housing 1' shown in FIGS. 6 to 13, together with its locking element 9', can be designed particularly to meet different requirements for visual appearance. Hence, for example, it is possible to design the plate shaped element 27 as a bright metallic component, while for the cup shaped part 2 white and black plastic materials can be used.

Figure 14:
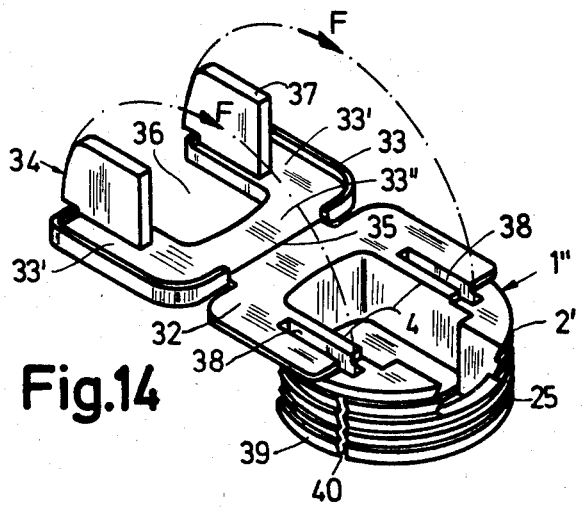
FIG. 14 is a perspective view of a further embodyment of the invention in the form of a hinge housing where the locking element is completely flipped open.
Figure 16:
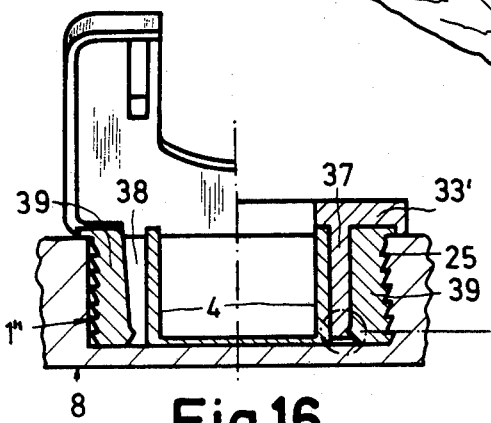
FIG. 16 is a section through the hinge housing of FIG. 14 in a plane across the slot shaped openings.
Figure 17:
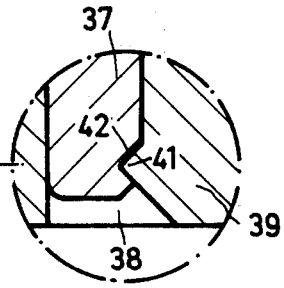
FIG. 17 is a detail of FIG. 16.

FIGS. 14 and 16 show another embodiment of the invention. A hinge housing 1" consists of a cup shaped part 2' with a circular cylindrical shaped circumferential face and an outwards projecting overhanging arm 32 on the upper end face of this cup shaped part 2. This overhanging arm 32 is integrally formed with and projects beyond the circumferential wall of the cup shaped part 2. On the external edge situated farthest from the cup shaped part 2', a plate shaped element 33 of a locking element 34 is pivoted on the overhanging arm 32. For an embodiment using plastic material, the element 33 is molded integrally with the cup shaped 2' or with the overhanging arm 32. The locking element 34 or the plate shaped element 33 can be swivelled in the direction of the arrow F relative to the cup shaped part 2'. The swivelling axis is formed, in an integral design, by a material section 35, preferably a material section of reduced thickness, which is used to connect the outside edge of the overhanging arm 32 with the plate shaped element 33. This material section 35 runs at right angles to the cup shaped part 2' as well as parallel to the inner surface of the furniture door 8 and connects the outside edge of the overhanging arm 32, situated farthest from the cup shaped part 2', with the plate shaped element 33.

The plate shaped element 33, used in this embodiment as a bracket, has an opening 36 which is open towards the edge of the plate-shaped element 33 opposite the material section 35. Thus this opening confers to the plate shaped element 33 a horseshow-shaped form with two arms 33' situated parallel to each other and projecting at right angles to the material section 35. These arms are connected by a yoke 33 arranged parallel to the material section 35.

A wall section 37, which is positioned with its upper surface side at right angles to the upper surface side of the plate shaped element 33 and arms 33' is molded on one surface side of each arm 33'. On folding the locking element 34 in the direction of the arrows F, each wall section 36 enters into a slot shaped opening 38. This slot shaped opening 38 in the wall of cup shaped part 2 is similar to the slot shaped opening 18 for the embodiment according to FIGS. 1 to 13. Both slot shaped openings 38 are provided in two opposite regions of the cup shaped element 2'. They project in a plane parallel to the axis of the cup shaped part 2'. The slot shaped openings 38 are each bounded towards the circumferential surface of the cup shaped part 2' by a circumferential wall section 39 and towards the inner chamber 4 of the cup shaped part 2' by a wall section. The openings 38 are, moreover, open towards the underside end face of the cup shaped part 2' not visible in FIG. 14. The circumferential wall sections 39 are each separated by notches 40, which project in the direction of the axis of the cup shaped part 2'. The notches also laterally separate wall section 39 from the remaining cup shaped part 2', so that the circumferential wall sections 39 are only connected to cup shaped part 2' at the upper end face of the cup shaped part 2'.

Figure 15:
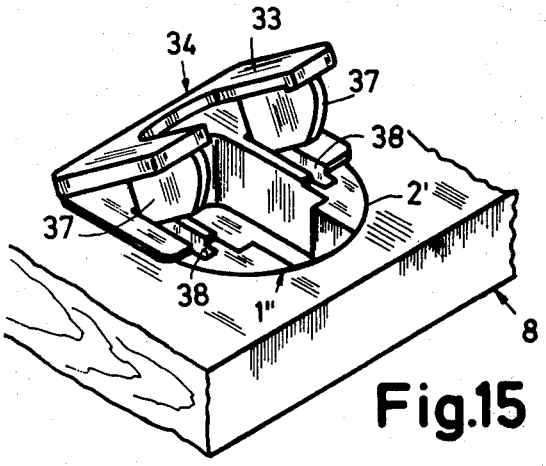
FIG. 15 is a perspective view of the hinge housing according to FIG. 14 inserted into the opening of a furniture door, in which the locking element is partly swivelled into the slot shaped opening of the hinge housing.

As shown particularly in FIG. 15, the width of the slot shaped opening 38 decreases from the upper end face of the cup shaped part 2' towards its lower end face. The shape of the slot shaped openings 38 ensure that the wall sections 37 which enter into the slot shaped opening 38 will expand the circumferential wall sections 39 radially outwards and thereby anchor the hinge housing 1" into the bore 7 of the furniture door 8. Several hooking ribs 25 are provided on the surface side of the circumferential wall section 39 to facilitate the anchoring.

If the hinge housing 1" is to be integrally molded from plastics material, then the corresponding form is designed so that the parts will have the position shown in FIG. 14 relative to each other after molding, i.e. the locking element 34, connected via the material section 35 to the cup shaped part 2', is positioned with the upper surface side of its plate shaped element 33 parallel to the surface sides of the overhanging arm 32. Because of this an especially simple design for the mold can be used in production.

In order to anchor the hinge housing 1" the locking element 34 is first swivelled in the direction of the arrows F relative to the cupshaped part 2' so that the surface of arm 33' having the wall sections 37 makes an acute angle with the surface of the overhanging arm 32. In this position the wall sections 37 project slightly into the slot shaped opening 38 (FIG. 15). The hinge housing 1" is inserted with its cup shaped part 2' into the bore 7 of the furniture door 8. For final anchoring the wall sections 37 are pushed completely into the slot shaped openings 38. As described above, the circumferential wall sections 39 are expanded radially outwards. This expanded position of the circumferential wall section 39 is shown on the right hand side of FIG. 16.

Ratchet elements are provided, which will hold the locking element 34 in the locking position to prevent loosening of the hinge housing 1". These ratchet elements consist in the simplest case of at least one lug 41 on the inner side of the circumferential wall section 39. These lugs project into the inner part of the slot shaped opening 38 and ratchet into corresponding grooves or depressions 42 on the wall section 37.

Figure 19:
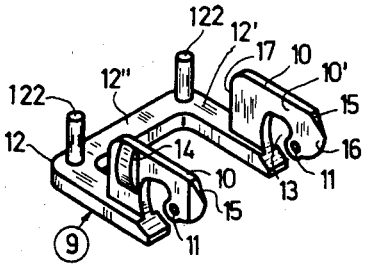
FIG. 19 is a perspective view of the locking element of FIG. 18, viewed from the side not visible in FIG. 18.
Figure 18:
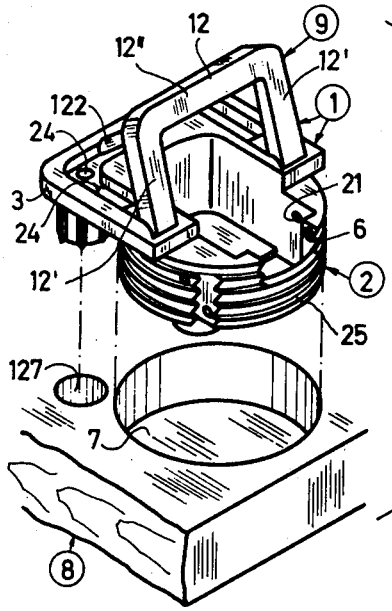
FIG. 18 is a perspective view of a further modification of the hinge housing according to the invention, together with a part view of a furniture door, before the insertion of the hinge housing into the furniture door.
Figure 20:
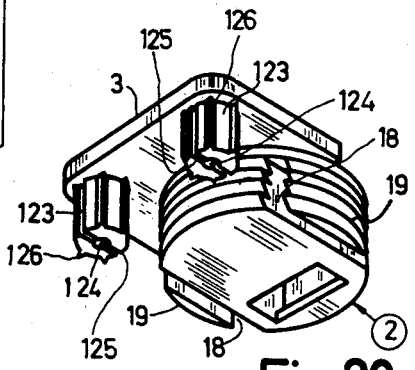
FIG. 20 is a perspective view of the hinge housing of FIG. 18, viewed from the side not visible in FIG. 18.

In FIGS. 18 to 20 is a modified embodiment of the hinge housing 1 in accordance with FIGS. 1 to 5. To the extent that design and disposition of the parts are identical with the embodiment shown in FIGS. 1 to 5, these parts are designated in FIGS. 18 to 20 by the same reference numerals as in FIGS. 1 to 5.

The modified embodiment shown in FIGS. 18 to 20 differs from the embodiment in accordance with FIGS. 1 to 5 essentially in that on the two ends of the yoke section 12" of the bracket 12, that is to say, at the point of transition between that yoke section and the legs 12', there is disposed in each an integral luglike projection 122 in such a way that these projections 122, whose axes are parallel to each other, extend at right angles from the underside of the bracket 12. Moreover, there are disposed on the underside of the crosspiece 3 and integral therewith two spreading pins 123 whose axes are likewise parallel to each other and which extend perpendicularly from the underside of the crosspiece 3. The pins 123 are further positioned in such a way that each pin 123 is adjacent to the portion of an opening 18 which is open to the circumferential wall of the cuplike part 2 and the axis of each pin is approximately in a plane which is delineated by the adjacent slotlike opening 18.

Each pin 123 has a bore 124 which extends in the longitudinal direction of the pin and terminates in the U-shaped groove 24 provided on the top of the crosspiece 3. This groove serves to accommodate the bracket 12 when the locking element 9 is in the locked position, as has been described above in conjunction with FIGS. 1 to 5. In order that the pins 123 may be spread by the projections 122, the bores 124 have at least over a portion, and preferably at the free end of the pins, a cross section which becomes smaller as the distance from the crosspiece 3 increases. Each pin has a longitudinal slot 125 and is further provided on its circumference with projecting ribs 126 which extend in the longitudinal direction of the pins. To accommodate the pins 123, the furniture door 8 has, in addition to the bore 7, two further bores 127, which in accordance with the disposition the pins 123 are provided in the furniture door 8 in such a way that the axes of the bores 127 together with the axis of the bore 7 form the corner points of an approximately equal-sided triangle.

Apart from this, the hinge housing 1 of FIGS. 18 to 20 corresponds to the hinge housing 1 of FIGS. 1 to 5, especially with regard to the design of the cuplike part 2 and of the locking element 9, and with regard to the manner in which that locking element is mounted in the cuplike part 2 of the hinge housing 1 of FIGS. 1 to 5.

The hinge housing 1 in accordance with FIGS. 18 to 20 is mounted in the same way as explained in conjunction with FIGS. 1 to 5, that is to way, with the locking element 9 in the nonlocking position, the cuplike part 1 is set into the bore 7 in the direction of the arrows C, the pins 123 are levers 10 are not effective as engagment edges, that is to say, are disposed within the peripheral area of the cuplike part 2 in the slotlike openings 18 when the hinge housing is anchored, the anchoring of the hinge housing 1 then being effected only by the engagement surfaces 14, the edges 15 and the pins 123 cooperating with the projections 122. However, the abutting of the edges 17 against the wall of the bore 7 in this embodiment offers the special advantage that the hinge pins 21 and the associated bores are largely relieved of shearing stresses since the edge 17 of each lever 10 comes to abut the wall of the bore 7, even when the edge 15 at the other end of the lever makes contact with that wall as the bracket 12 is swung into the locking position. This relieving of the hinge pins 21 and their bores from shearing stresses is particularly advantageous since the projections 122 are completely outside the bores 124 when the locking element 9 is in the nonlocking position and enter the bores 124 only at a relatively late stage as the locking element 9 is swung into the locking position. If the hinge pins 21 were not relieved of shearing stresses, it might happen that because of the natural elasticity of the material used in the manufacture of the cuplike part 2 the locking element would be displaced relative thereto slightly but sufficiently to make it difficult for the projections 122 to enter the bores 124.

The invention has been described above in terms of exemplified embodiments. It will be understood that the claims are intended to cover all changes and modifications of the preferred embodiments of the invention herein chosen for the purpose of illustration which do not constitute departures from the spirit and the scope of the invention.

What is claimed is:

1. A furniture fitting comprising:
(a) a housing including a portion having a circumferential wall having a circumferential outline for fitting within a corresponding bore of a furniture component;
(b) locking means including at least one locking element pivotally mounted on said housing for pivoting about a pivoting axis thereon, said pivoting axis extending through the circumferential wall of said portion;
(c) said portion having an opening therein for receiving said locking element;
(d) said locking element being pivotable from a position at least partially outside of said opening into a second position within said opening; and
(e) means on the locking element for increasing the circumferential outline of said portion when the locking element is pivoted into said opening whereby said fitting is anchored in said bore when said portion is fitted into said bore and said locking element is pivoted into its second position within said opening.

2. A furniture fitting according to claim 1 wherein the circumferential wall of said portion is cylindrically shaped.

3. A furniture fitting according to claim 1, wherein said opening in said portion is a slot-shaped opening, said opening being bounded laterally by opposing wall sections disposed at right angles to the pivoting axis of the locking element, said locking element being guided between said opposed wall sections when said swivelled into the second position.

4. A furniture fitting according to claim 3, wherein the locking element is a flat lever having surface sides situated at right angles to the pivoting axis of the locking element.

5. A furniture fitting according to claim 3, wherein the slot-shaped opening also opens toward the circumferential wall of said portion, and wherein said means on the locking element for increasing the circumferential outline of said portion includes at least one projection forming an engagement surface on the locking element, said engagement surface projecting out of the slot-shaped opening beyond the circumferential wall of said portion in the second position of the locking element.

6. A furniture fitting according to claim 5 wherein said engagement surface is formed by an edge of said projection of the locking element, said edge being situated within the slot-shaped opening when said locking element is in the first position and, upon the swivelling of the locking element into the second position said edge projects beyond the circumferential wall of said portion.

7. A furniture fitting according to claim 5, wherein the edge forming the engagement surface is situated in the first position of said locking element outside the slot-shaped opening.

8. A furniture fitting according to claim 3 wherein said circumferential wall is cylindrically shaped and wherein the lateral bounding surfaces of the slot-shaped opening are situated in planes which run parallel to each other and which intersect the circumferential wall of said portion as a chord thereof.

9. A furniture fitting according to claim 5, wherein the lever is supported at one end thereof for swivelling in the slot-shaped opening, said lever having at said one end a projection which projects beyond the pivoting axis, and an edge of this projection forms the engagement surface.

10. A furniture fitting according to claim 9, wherein said edge has a curvature such that the distance between the edge and the pivoting axis increases in a direction opposite to the direction in which the locking element is swivelled from said first position into said second position.

11. A furniture fitting according to claim 5, wherein the edge forming the engagement surface is a knife cutting edge.

12. A furniture fitting according to claim 3, wherein the slot-shaped opening is bounded toward the circumferential wall of said portion by a radially outwardly expandable circumferential wall section, and the locking element is a flat lever having surface sides extending at right angles to the pivoting axis of the locking element, and wherein said means for increasing includes a wedge on at least one of the surface sides of said lever, said wedge, in the second position of the locking element, being operative to expand said circumferential wall section in a radially outward direction.

13. A furniture fitting according to claim 3, wherein the slot-shaped opening is bounded towards the circumferential wall of said portion by a radially outwardly moveable circumferential wall section, wherein the locking element is a flat lever, said flat lever having surface sides extending at right angles to the pivoting axis of the locking element, and wherein the slot-shaped opening tapers inwardly in the direction of swivelling movement of the locking element from the first into the second position.

14. A furniture fitting according to claim 3, wherein said locking element is a first locking element and said slot-shaped opening is a first slot-shaped opening and further comprising a second locking element associated with a second slot-shaped opening in said portion, said locking elements being connected to each other by bracket means.

15. A furniture fitting according to claim 14, wherein said housing further comprises a lateral-projecting overhanging arm affixed to said portion, said bracket means being restable on said overhanging arm whenever said locking elements are in said second position.

16. A furniture fitting according to claim 15, wherein said lateral-projecting overhanging arm has a groove for receiving a portion of said bracket means whenever said locking elements are in said second position.

17. A furniture fitting according to claim 14, further comprising:
(a) said housing including an overhanging arm affixed to said portion;
(b) at least one fastening plus on said overhanging arm for anchoring into another accommodating bore of said furniture component;

(c) at least one pin projecting from said bracket means;

(d) a longitudinal bore in said fastening plug for receiving said pin, said pin being operative for increasing the circumferential outline of said fastening plug when said pin is received in said longitudinal bore; and (e) said pin being received in said longitudinal bore when said locking element is in said second position.

18. A furniture fitting according to claim 17, wherein said longitudinal bore in said fastening plug tapers inwardly in the direction away from said overhanging arm.

19. A hinge housing comprising:

(a) a cylindrical cup-shaped portion, having a circumferential wall, which portion is anchorable in an accommodating bore of a furniture component;

(b) at least one locking element;

(c) at least one pivot pin on said hinge housing for pivotally attaching said locking element, said pivot pin extending into the circumferential wall of said portion;

(d) said locking element comprising a lever having a cutting edge;

(e) at least one slot-shaped opening for accommodating said lever in said cylindrical cup-shaped portion;

(f) said lever having a first unlocking position and a second locking position;

(g) said lever having means for increasing the circumferential outline of said portion, when the locking element is swivelled from said first unlocking position into said second locking position, the locking element being positioned in said slot-shaped opening in said second position;

(h) said means on the locking element for increasing the circumferential outline of said portion comprising:

(i) a projection of the lever forming the locking element extending through said slot-shaped opening outside said cylindrical cup-shaped portion whenever the locking element is in the second, locking position;

(ii) a radially outwardly moveable circumferential wall section on said cylindrical cup-shaped portion, said circumferential wall section bounding said slot-shaped opening toward the circumferential wall of said cylindrical cup-shaped portion;

(iii) said lever having a wedge-shaped cross section whereby said circumferential wall section is expanded outward when said locking element is in the second position.

20. A furniture fitting according to claim 18, further comprising:

(a) said cylindrical cup-shaped portion having an overhanging arm;

(b) an expandable fastening plug affixed to said overhanging arm; and (c) means on said locking element for expanding said expandable fastening plug whenever said locking element is in the second, locking position.

21. A furniture fitting according to claim 1, wherein said locking element is pivotally attached by means of a flexible joint formed by a pliable section of material.

* * * * *